US009493325B2

(12) United States Patent
Kocher et al.

(10) Patent No.: US 9,493,325 B2
(45) Date of Patent: Nov. 15, 2016

(54) SLIDING GUIDE SHOE FOR AN ELEVATOR

(71) Applicant: INVENTIO AG, Hergiswil NW (CH)

(72) Inventors: Hans Kocher, Udligenswil (CH); Hubert Steiner, Ebikon (CH); Stephan Hess, Emmenbrucke (CH)

(73) Assignee: Inventio AG, Hergiswil (CH)

( * ) Notice: Subject to any disclaimer, the term of this patent is extended or adjusted under 35 U.S.C. 154(b) by 746 days.

(21) Appl. No.: 13/650,443

(22) Filed: Oct. 12, 2012

(65) Prior Publication Data

US 2013/0098714 A1 Apr. 25, 2013

(30) Foreign Application Priority Data

Oct. 24, 2011 (EP) ..... 11186391

(51) Int. Cl.
*B66B 7/04* (2006.01)

(52) U.S. Cl.
CPC ..... *B66B 7/047* (2013.01)

(58) Field of Classification Search
CPC ..... B66B 7/047; B66B 7/04; B66B 7/042
USPC ..... 187/409
See application file for complete search history.

(56) References Cited

U.S. PATENT DOCUMENTS

| | | | | |
|---|---|---|---|---|
| 2,045,620 | A * | 6/1936 | Spullies | 187/409 |
| 2,103,480 | A | 12/1937 | Mason | |
| 4,598,798 | A * | 7/1986 | Koppensteiner | 187/409 |
| 2013/0126278 | A1* | 5/2013 | Sederholm et al. | 187/409 |
| 2016/0207737 | A1* | 7/2016 | Hess | B66B 7/047 |

FOREIGN PATENT DOCUMENTS

| | | | | |
|---|---|---|---|---|
| DE | 3817339 | A1 * | 12/1988 | B66B 7/04 |
| DE | 20315915 | U1 | 2/2005 | |
| DE | 202010000849 | U1 * | 6/2011 | |
| EP | 1880968 | A1 | 1/2008 | |
| EP | 2607287 | A1 * | 6/2013 | |
| JP | 58-191171 | U | 12/1983 | |
| JP | H04-9873 | U | 1/1992 | |
| JP | 2001261259 | A | 9/2001 | |
| JP | 2006-103896 | A | 4/2006 | |

* cited by examiner

*Primary Examiner* — William E Dondero
*Assistant Examiner* — Diem Tran
(74) *Attorney, Agent, or Firm* — Fraser Clemens Martin & Miller LLC; William J. Clemens

(57) ABSTRACT

A sliding guide shoe for an elevator for conveying persons or goods includes a guide shoe housing and a two-part insert, which insert is inserted in the guide shoe housing for guiding an elevator car along a guide rail extending in a longitudinal direction. The insert includes a slide element connected with a support element and removable laterally from the sliding guide shoe in the longitudinal direction. The slide element is insertable into or removable from the support element only from one longitudinal side.

18 Claims, 7 Drawing Sheets

SLIDING GUIDE SHOE FOR AN ELEVATOR

FIELD

The invention relates to a sliding guide shoe for an elevator for conveying persons or goods, and to a method of servicing or updating an elevator installation with sliding guide shoes.

BACKGROUND

Sliding guide shoes are frequently used for guiding elevator cars. Elevator installations in buildings usually have a vertical elevator shaft in which a respective guide rail is arranged at each of mutually opposite shaft walls. Sliding guide shoes arranged at the elevator car have inserts with slide surfaces which slide with small play along a guide rail. Sliding guide shoes are known and conventional in which the inserts are designed as profile members which are U-shaped in cross-section. By contrast to roller guide shoes, the sliding guide shoe basically manages without movable parts. Since the inserts wear in the course of time, used or old slide inserts have to be exchanged.

DE 203 15 915 U1 shows a sliding guide shoe with a two-part insert consisting of a support element and a slide element. The slide element can be exchanged, in which case, however, the entire sliding guide shoe has to be demounted after initial placing of the elevator in operation. In practice it has proved that—even after the sliding guide shoe has been demounted from the car—the slide element inserted into a pocket-like recess, which is open towards the front side, in the support element can be removed from the support element only with difficulty. In addition, the insertion or re-insertion of a slide element is difficult, since due to the specific selection of material and design of receiving pocket and slide element a simple insertion into the pocket is hardly possible.

A sliding guide shoe with an insert has become known from EP 1 880 968 A1, which sliding guide shoe is received in a channel-like receptacle, which extends in longitudinal direction, in the guide shoe housing. Respective retaining elements are screw-connected with the guide shoe housing in the region of the two longitudinal sides for lateral securing of the insert. This insert can be removed—without demounting of the entire guide shoe—from the guide shoe by lateral withdrawal in longitudinal direction along the guide rails. The inserts conceived as wear parts are, however, comparatively expensive and complicated in production.

SUMMARY

The invention disclosed herein avoids the disadvantages of the prior art and, in particular, creates a sliding guide shoe which is simple in handling particularly for updating or maintenance operations. Moreover, the wear parts of the sliding guide shoe can be replaced and exchanged simply and economically. Finally the sliding guide shoe shall fulfil high demands with respect to slide properties and damping behavior.

According to the invention the above features are fulfilled by a sliding guide shoe with a two-part insert including a slide element and a support element, wherein the slide element is detachably connected with the support element. The support element in that case preferably has slide surfaces which contact the guide rail with small play. The support element can have damping characteristics by virtue of appropriate material selection, structural construction or shaping, whereby a low-vibration travel of the car can be ensured. The support element itself has no sliding function at least in the normal case. Due to the fact that the slide element is so connected or connectible with the support element that it is removable laterally from the sliding guide shoe in a longitudinal direction or insertable thereinto, the slide element can be exchanged and replaced as a wear part even after first placing of the elevator installation in operation and without involved precautions. In particular, it is possible to remove the slide element while the rest of the sliding guide shoe remains at the guide rail extending in longitudinal direction. After removal of the slide element the support element is always still in the inserted position in the guide shoe housing.

The support element and in a given case also the slide element are at least in the inserted state formed as profile members which are U-shaped in cross-section, wherein the profile member longitudinal direction corresponds with the longitudinal direction predetermined by the guide rail. The U profile member can have two limb walls and a web wall connecting these. The support element and/or the slide element can each be made from flat blanks, in which case the limb walls are, for example, connected with the web wall by way of film hinges. In order to form the profile member shape the blank can be erected from a planar rest position. Instead of a slide element formed as a unitary component the slide surfaces could, however, also be formed by separate components. The outer components of the insert, i.e. the support element, can consist of a comparatively resilient plastic material such as, for example, elastomers based on PU, rubber-like materials such as synthetic rubber (for example EPDM or NBR) or natural rubber (NR). Noises and vibrations can be damped by the support element. The slide element can consist of a comparatively stiff plastics material. Good sliding characteristics can be achieved if the slide element is made from, for example, a material such as PTFE or UHMW-PE with a low coefficient of friction.

The sliding guide shoe could be formed in such a manner that the slide element can be pushed into or withdrawn from the support element from both sides in longitudinal direction. However, particular advantages result if the slide element is pushable into or withdrawable from the support element from only one longitudinal side. With this arrangement, it is possible to create a simpler sliding guide shoe consisting of few individual parts.

With particular advantage the slide element is supported with respect to the longitudinal direction on one side by a respective abutment, up to which the slide element can be pushed into the support element to limited extent. The abutment can in that case be predetermined by the support element, by the guide shoe housing or possibly even by a separate part.

For that purpose the support element has at least one recess, which extends up to a shoulder in longitudinal direction, for reception of the slide element. The respective slide element can be introduced and inserted into this recess from one longitudinal side. The shoulder in that case forms an abutment for the slide element, up to which the slide element can be pushed into the support element. The non-continuous recess extending in longitudinal direction reaches from an open longitudinal side up to the mentioned shoulder, wherein the shoulder can be formed by, for example, a step in the support element.

The support element can fixed or fixable mechanically positively or frictionally in the guide shoe housing by way of fastening means. However, it would also be conceivable to fix the support element in the guide shoe housing with use of adhesive.

If the sliding guide shoe has mutually opposite slide surfaces and a slide surface extending transversely thereto, which are slidably movable along guide surfaces of the guide rail preferably with small play, it can be advantageous if a slide element predetermines the three slide surfaces, wherein the slide element is formed as a preferably integral and monolithic component.

Alternatively, the sliding guide shoe can comprise three slide elements, wherein each slide elements forms a respective slide surface. This arrangement has on the one hand, advantages in terms of production engineering, since the simply shaped slide elements can be produced in simple and economic manner. The slide elements of suitable plastics materials can, for example, be produced by extrusion. Depending on the respective material selection, the slide elements could also be designed as injection-moulded parts of plastics material. However, other production methods would obviously also be conceivable. On the other hand, this arrangement permits a wear-dependent exchange of wear parts. Slide elements possibly still regarded as new thus do not have to be replaced at every service interval. The arrangement with several slide elements is, moreover, advantageous in the respect that it is particularly suitable for an oil-free mode of operation. In principle, it would even be conceivable for only the mutually opposite slide surfaces to be used for the sliding guidance of the car, whilst the guide surface of the guide rail extending transversely thereto would not be loaded or, for example, loaded by way of a roller guidance by the sliding guide shoe. In this case, the sliding guide shoe would comprise only two slide elements.

The individual slide elements can be formed as plate-shaped bodies. Slide elements of that kind can be produced particularly simply and economically.

Moreover, it can be advantageous if three fastening grooves each for preferably (with respect to the direction of insertion or longitudinal direction) mechanically positive reception of a respective slide element are provided in the support element. With particular advantage the fastening groove can have undercuts and the slide element wedge-shaped edge sections complementary to the undercuts, whereby a dovetail connection between slide element and support element results.

The combination of the three fastening grooves, which form the recesses mentioned in the introduction, with the slide elements receivable therein is also advantageous for sliding guide shoes with other designs of the recesses. For example, for specific fields of use it is not absolutely necessary for the slide elements to be supported on a shoulder formed by the support element. Such a sliding guide shoe can thus have continuous recesses (without a shoulder) extending in longitudinal direction.

An advantageous fixing arises if the support element comprises at least one bearing pin formed, preferably monolithically, at the support element and if the guide shoe housing has a cut-out, which is complementary with the bearing pin, for receiving the retaining pin.

For securing the slide element a holding element can be provided which is fastened or fastenable to the guide shoe housing in the region of a longitudinal side. The slide element can thus be enclosed between the holding element and the aforementioned abutment, whereby the slide element is securely held in the guide shoe housing.

Moreover, it can be advantageous if the holding element has a fastening wall section resting or placeable areally on the guide shoe housing and a holding wall section, which is spaced from the guide shoe housing, for fixing the insert. The holding wall section and the fastening wall section can in that case lie in planoparallel planes.

The holding element can be a bent part of metal. The holding element can thus be made from a single sheet-metal blank and shaped by sheet-metal deforming methods.

The sliding guide shoe can further comprise a preferably separate protective element for protecting the slide surfaces from contaminations. The protective element can in that case be positioned at the holding element on an inner side facing the at least one slide element or, for example, be mounted by gluing. In completely assembled position the protective element bears against the slide element or slide elements and sealingly protects these.

The protective element preferably consists of a non-metallic material. It can also consist of plastics material and preferably of a plastics material with resilient properties (for example, elastomers). PUR, EPDM, NBR and NR are, for example, particularly suitable. In addition, it is conceivable for the protective element to be made from a felt or non-woven material.

The sealing action for protection of the slide surfaces can be further improved if the protective element is of areal form and has a first flat section and an inwardly adjoining sealing section, which has a smaller thickness than the first flat section and predetermines a contact area for the slide element. A step can be present between the flat section and sealing section. An outer edge of an end of the slide element can be fitted in the step. Additionally or alternatively, the sealing section can inwardly form a form of sealing lip which acts on the guide rail.

In a further form of embodiment the protective element and the holding element can each have an incision at least partly enclosing the guide rail in the operating position. The protective effect can be increased if the incision of the protective element is narrowed relative to that of the holding element.

It can be advantageous for handling if the slide elements employed project beyond the support element and/or beyond the guide shoe housing. The part of the slide element projecting beyond the support element and/or the guide shoe housing can be easily gripped and pulled out. For simple gripping, for example by index finger and thumb or by pliers, the projection should preferably be at least 5 millimeters and, particularly preferably, about 10 millimeters. The support element can be designed in such a manner that it has an upper end which in inserted setting is arranged to be inwardly offset relative to an adjacent housing surface and/or an edge of the slide element in the region of the longitudinal side, whereby a recess or a cavity open towards to the longitudinal side is created between the guide shoe housing and slide element. The slide element can be gripped in simple mode and manner by way of the mentioned cavity and then pulled out.

The completely inserted support element can approximately flushly or steplessly adjoin the guide shoe housing at the housing surface in the region of the longitudinal side.

A further aspect of the invention could relate to a car for an elevator with at least one sliding guide shoe in the afore-described manner.

A further aspect of the invention relates to a method of updating an elevator installation equipped with, in particular, the afore-described guide shoes. The method is primarily distinguished by the fact that on renewal of an insert, which comprises at least one slide element and a support element, for the sliding guide shoe the slide element is exchanged. In the exchange process the guide shoe in that case remains, together with the support element, at the guide rail. The slide element to be renewed is removed by lateral pulling out in longitudinal direction from the guide shoe. A new slide element is inserted into the guide shoe from the same side. An insert secured by one or possibly two holding elements obviously still has to be released beforehand.

DESCRIPTION OF THE DRAWINGS

Further advantages and individual features are evident from the following description of an embodiment and from the drawings, in which.

DETAILED DESCRIPTION

Figure 1:
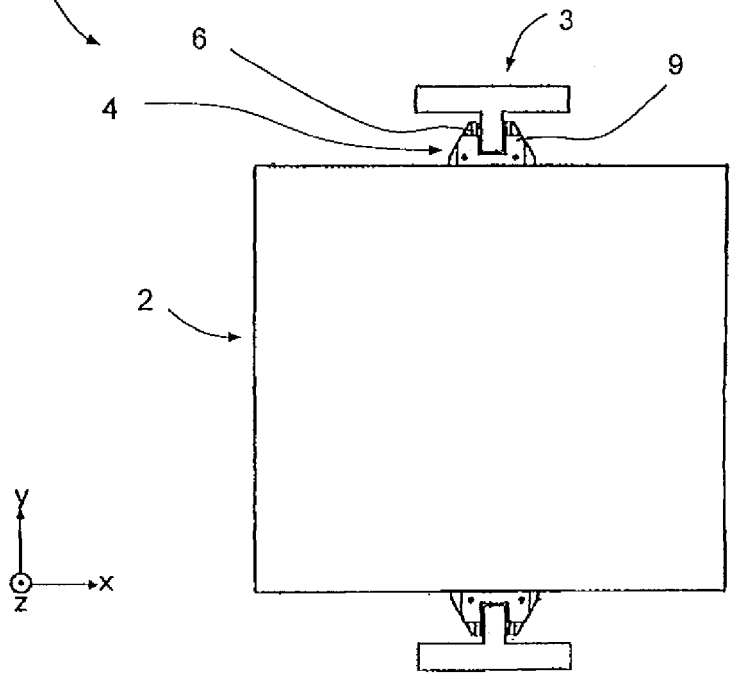
FIG. 1 shows a simplified illustration of an elevator according to the invention with an elevator car, which is guided at guide rails by way of sliding guide shoes, in a plan view.

FIG. 1 shows an elevator, which is denoted overall by 1, with an elevator car 2, which is movable up and down in z direction in an elevator shaft (not shown) with vertical guidance between two guide rails 3. The linear guidance with the guide rail 3 is in the present case formed by, for example, a T profile member extending in the longitudinal direction z. At least one guide shoe 4 for guiding the car 2 at the guide rails 3 is arranged at the elevator car 2 on each side. For optimal guidance, elevator cars usually have four (two per side) or more sliding guide shoes. The sliding guide shoe has an insert 6, which is U-shaped in cross-section and embraces the guide rail 3 and which extends—like the guide rail—in the longitudinal direction z. The insert 6, described in more detail in the following, is secured in terms of position by a holding element denoted by 9.

Figure 2:
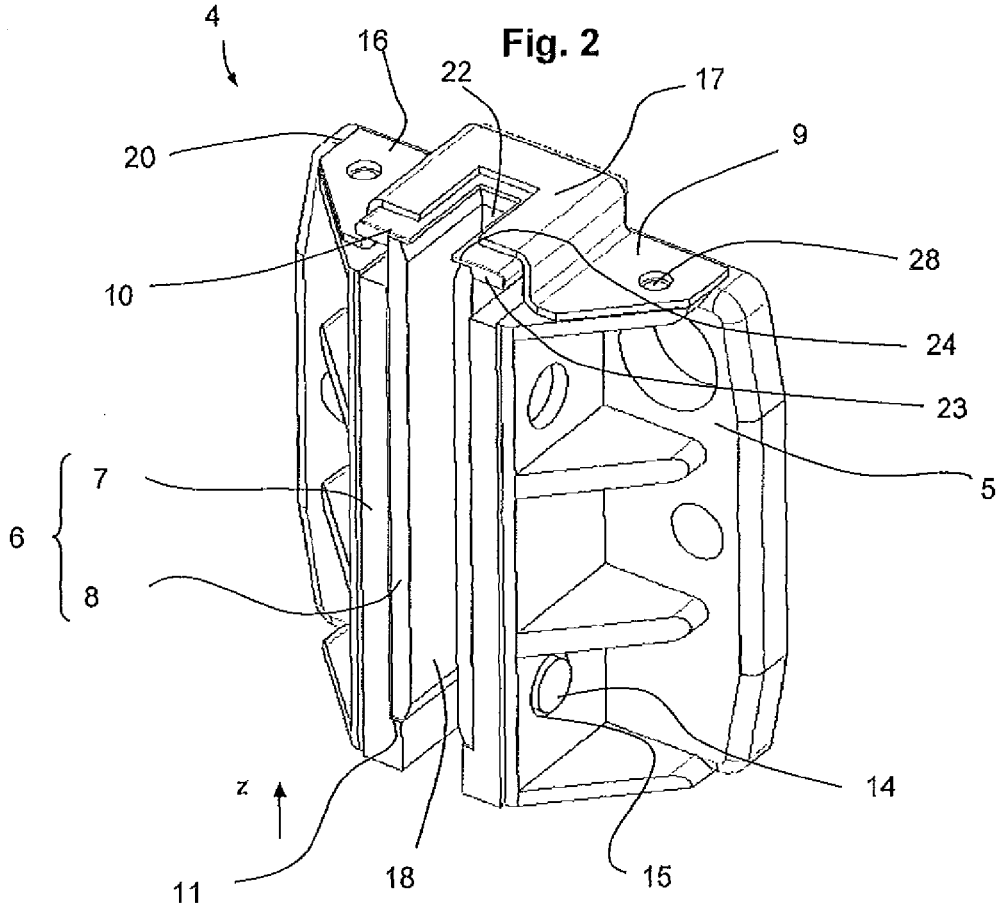
FIG. 2 shows a perspective view of a sliding guide shoe of the elevator according to FIG. 1.

Details with respect to a possible constructional form of the sliding guide shoe 4 according to the invention are evident from FIG. 2. The sliding guide shoe 4 has a channel-like receptacle, which extends in the longitudinal direction z, for the guide rail (not shown here). The respective guide surfaces of the guide rail are, in the case of travel movement in z-direction, slidingly acted on by mutually opposite, approximately planoparallelly extending slide surfaces 18 and a slide surface 22, which extends transversely thereto, with small play. The two slide surfaces 18 are formed by the inner sides, which face the guide rail, of the slide element denoted by 8, which together with a support element 7 forms the insert 6. The insert 6 is fixed in the guide shoe housing 5 of the guide shoe by bearing pins 14, which engage in corresponding cut-outs 15 of a guide shoe housing 5. The guide shoe housing 5, which in the present case is of integral form, consists of a metallic material (for example, steel). The outer insert component 7 consists of a material by which noises and vibrations during car travel can be damped. A resilient plastics material (for example, PUR, EPDM, NBR or NR) can, for example, be used for that purpose. Thereagainst, the slide element 8 consists of a comparatively stiff plastics material, which is further distinguished by a low coefficient of friction (PTFE, UHMW-PE, etc.). The sliding guide shoe 4 is thereby distinguished by the fact that an oil-free guidance is made possible.

The slide element 8, which is U-shaped in cross-section in the assembled state according to FIG. 2, is enclosed between a shoulder 11 and a cover-shaped arrangement with a protective element 10 for protection of the slide surfaces 18 from contaminations and a holding element 9. The holding element 9 is formed as a bent part of metal, which is fixed by means of screws (not illustrated here) to the guide shoe housing 5. Corresponding holes through which the screws are insertable are denoted by 28.

Figure 3:
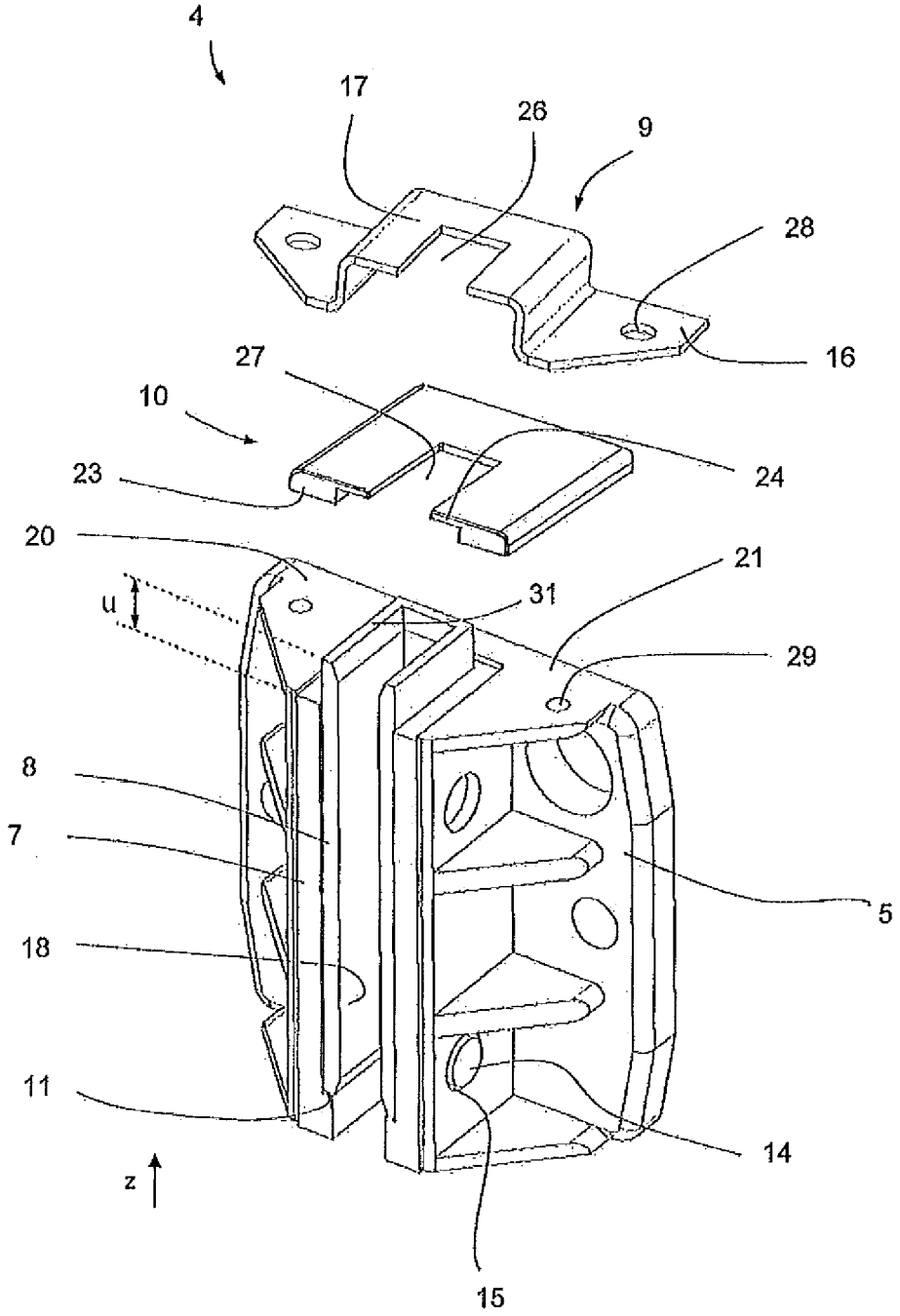
FIG. 3 shows the sliding guide shoe of FIG. 2 with detached holding element and protective element.

In the case of the sliding guide shoe 4 according to FIG. 3 the holding element 9 and the protective element 10 were detached, whereby further constructional features of the invention can be seen. Thus, for example, it is evident from FIG. 3 that the slide element 8 projects beyond the guide shoe housing. The projection, which can be 5 millimeters and more, is indicated by u. Thereagainst, the support element 7 is approximately flush with the housing surface, which is denoted by 21, in the region of the longitudinal side 20. After removal of the cover containing holding element 9 and protective element 10 the upper longitudinal side 20 of the slide element 8 is exposed and can be easily gripped. This projection makes it possible for, for example, maintenance personnel to be able to easily remove the slide element 8 from the guide shoe for exchange, required for servicing, of the slide element. For this purpose, it is merely necessary to grip the part of the slide element 8 protruding beyond the guide shoe housing 5 and to pull it out in the z direction. Since the slide element 8 can also be withdrawn when the rest of the sliding guide shoe remains at the guide rail, significant advantages arise for updating and maintenance with respect to saving of time and ease of handling. The laborious and time-intensive demounting of the entire sliding guide shoe from the car does not have to be undertaken.

The holding element 9 has a fastening section 16, which is provided with passage holes 28, and a holding wall section 17 extending planoparallelly to the plane of the fastening section. In addition, two holes 29, which for fastening the holding element 9 can be formed as passage holes or threaded holes, into which screws (not illustrated) can be inserted or screwed, can be seen in the region of the longitudinal side 20 of the guide shoe 5. As apparent, the protective element 10 is of flat construction and consists of a soft non-metallic material (for example, plastics materials or felt). The protective element 10 has a first flat section 23 and a sealing section 24 which adjoins thereto and has a smaller thickness. The sealing section 24 provides a contact area with respect to the slide element (cf. FIG. 2). A step is present at the inner side between flat section 23 and sealing section 24. The edge of the slide element facing the holding element is of complementary form and can be fitted into the step. In addition, it can be seen in FIG. 4 that the protective element 10 and the holding element 9 each have an incision 27 or 26 enclosing the guide rail. The incision 27 of the protective element 10 is, for optimum protective effect, narrowed by comparison with the incision 26 of the holding element 9.

Figure 4:
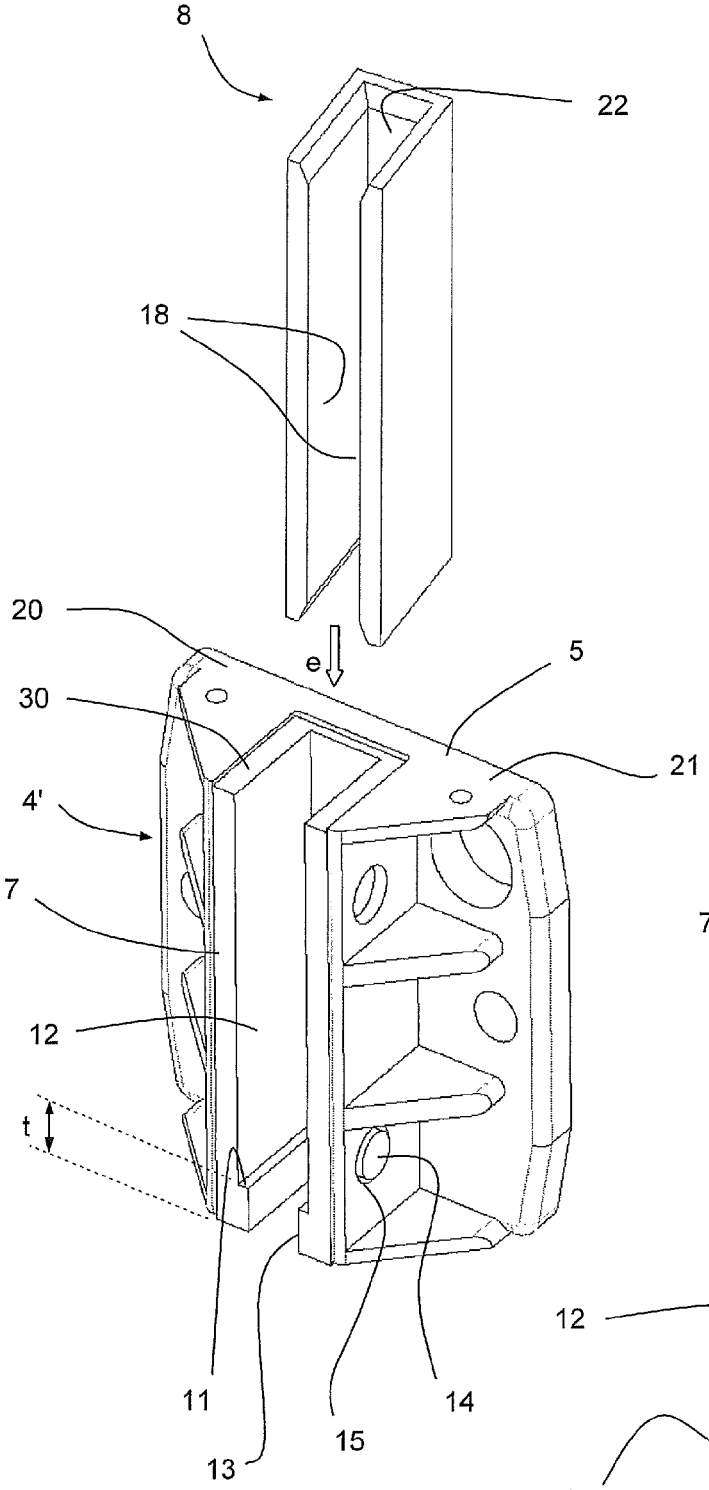
FIG. 4 shows the sliding guide shoe with demounted slide element.
Figure 5:
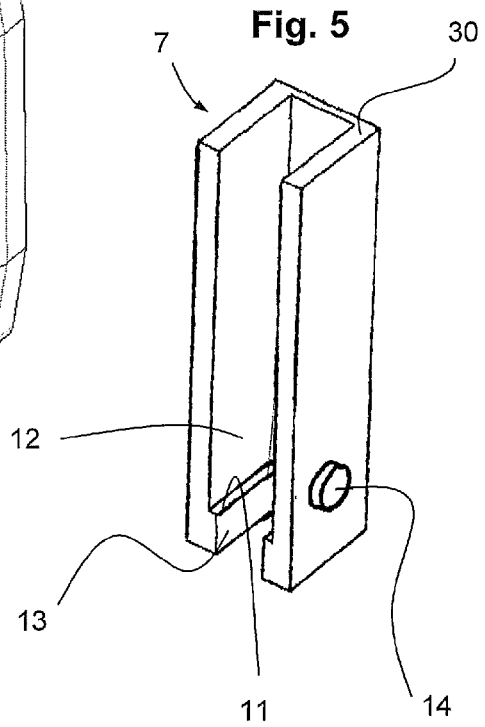
FIG. 5 shows a support element for the sliding guide shoe.

FIG. 4 shows a remaining sliding guide shoe which is denoted by 4' and from which the slide element has been laterally removed. The slide element 8 is in the present case designed as a profile member which not only in inserted state, but also outside the guide shoe defines a U shape. However, it would also be conceivable to separate the individual walls from one another by film hinges. The slide element thus would be erectable from a flat position by erecting the limb walls to form a U profile member. The support element 7 has a recess 12 which extends up to a shoulder 11 and which forms a receiving section for the receiving the slide element. The shoulder forms the abutment, up to which a slide element can be pushed in. The distance of the shoulder 11 up to the lower longitudinal side of the guide shoe is denoted by t and approximately corresponds with the desired projection of the slide element. For re-insertion of the slide element 8 (or insertion of a new slide element) this merely has to be pushed into the support element 7 from the longitudinal side 20 in an insertion direction indicated by an arrow e. In addition, it can be seen that the inner walls of the slide element are chamfered at both longitudinal-side ends. The support element 7 is again shown in an individual illustration in FIG. 5.

Figure 6:
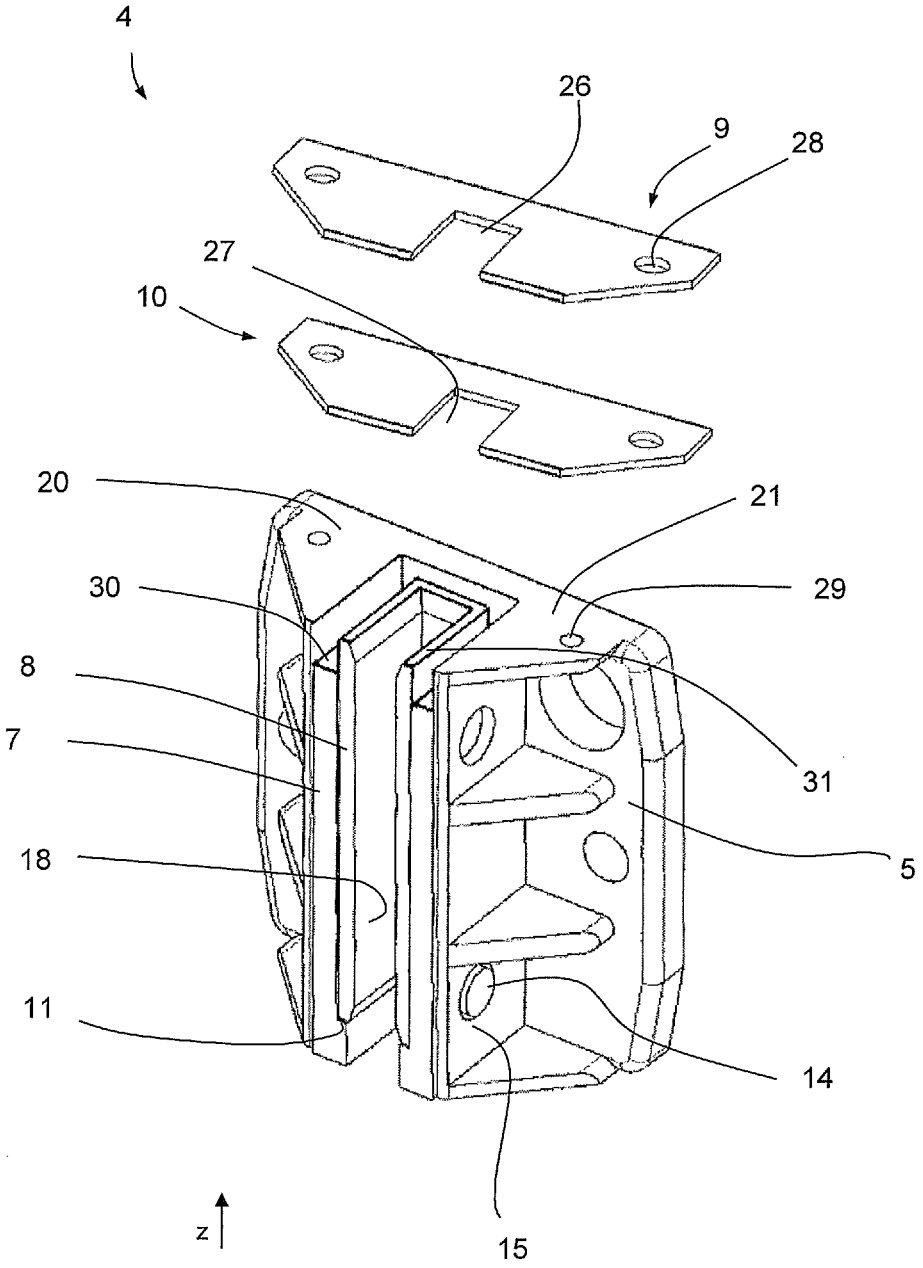
FIG. 6 shows an alternative sliding guide shoe with detached holding element and protective element.

FIG. 6 shows a variant of the first embodiment. The sliding guide shoe 4 illustrated in FIG. 6 is distinguished by the fact that the end 30, which faces the upper longitudinal side 20, of the support element is arranged to be inwardly offset relative to the corresponding housing upper side 20 or housing surface 21. Through this inward offset a recess arises by way of which the slide element 8 can be easily gripped or grasped and then withdrawn. Since the upper edge 31 of the completely inserted slide element 8 ends at approximately the same plane as the surface 21 in the region of the longitudinal side 20, the holding element 9 can be formed by a simple plate-like component. The similarly flat protective element 10 can, for example, be made from a felt blank.

Figure 7:
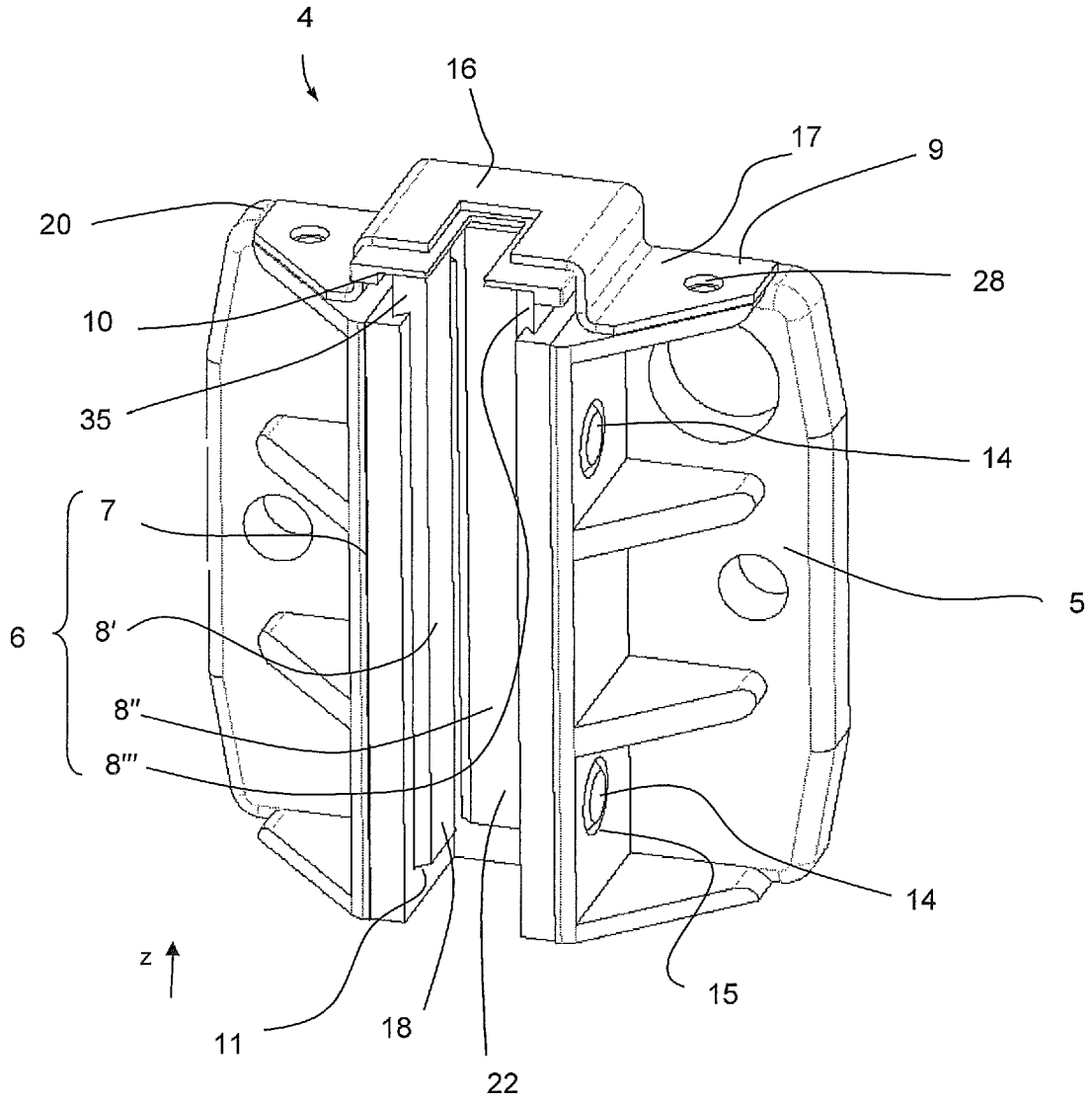
FIG. 7 shows a perspective illustration of a sliding guide shoe according to a further embodiment.

As evident from FIG. 7, the sliding guide shoe can also comprise a plurality of slide elements. In the present case, an individual slide element 8', 8", 8'" is associated with each of the three slide surfaces 18. The three side elements 8', 8" and 8'" have, in the present case, the same shape and consist of, for example, UHMW-PE or Teflon (Registered Trade Mark). The slide elements 8', 8", 8'" are inserted into three fastening grooves, which are of complementary form, in the support element 7 and can be removed from the guide shoe by withdrawal in the longitudinal direction z.

Figure 8:
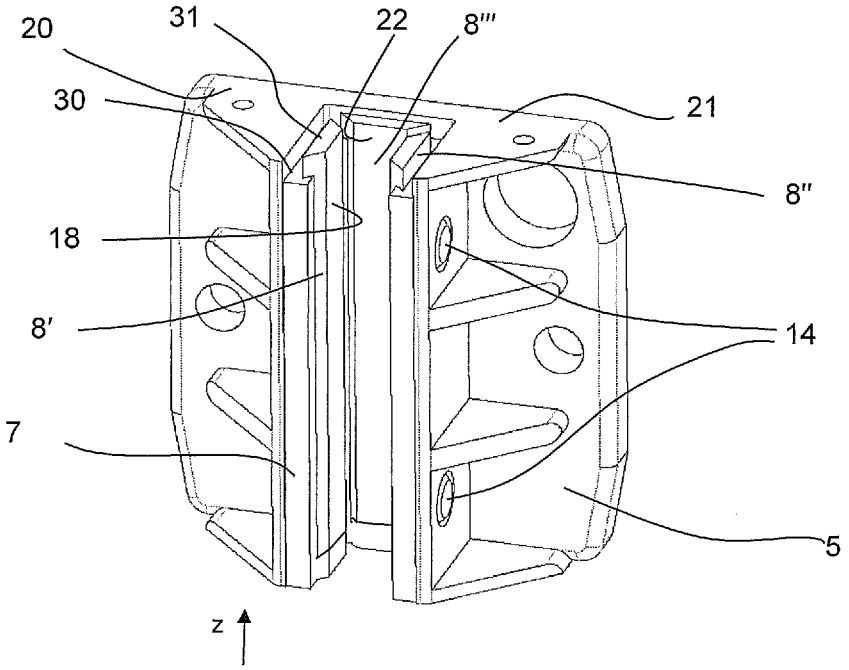
FIG. 8 shows a variant of the sliding guide shoe according to FIG. 7.

For clarification of the form of connection between the slide elements 8', 8" and 8'" and the support element 7 the sliding guide shoe is illustrated in FIG. 8 without a holding element and a protective element. As apparent, the slide elements 8', 8" and 8'" are inserted into the support element 7 by way of a dovetail connection. By comparison with the embodiment of FIG. 7 the support element 7 is shortened with respect to the longitudinal direction so that a cavity forms in the region of the longitudinal side 20, by way of which cavity the slide elements can be gripped or grasped and then withdrawn from the individual fastening grooves in longitudinal direction.

The sliding guide shoe 4 makes possible an advantageous procedure for updating an elevator installation. For renewing the inserts of the sliding guide shoes the elevator car (not illustrated here) is initially stopped, whereupon the following working steps are performed: The slide elements 8', 8", 8'" are exchanged, in which case in the exchange process the sliding guide shoe together with the support element 7 remains at the guide rail and the slide elements 8', 8", 8'" to be renewed are removed from the sliding guide shoe 4 by lateral withdrawal in the z direction. New slide elements can thereupon be inserted into the sliding guide shoe from the longitudinal side 20 in the opposite direction to the arrow z.

Figure 9:
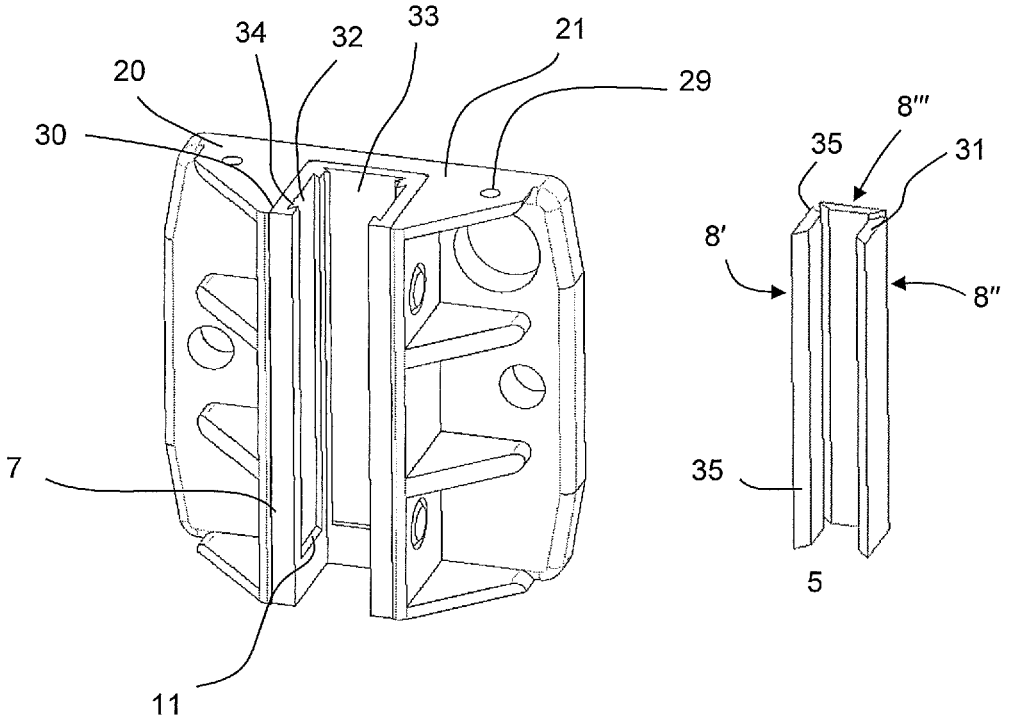
FIG. 9 shows the sliding guide shoe of FIG. 8 with demounted slide elements.

In FIG. 9 the support element 7 steplessly adjoins, in the region of the longitudinal side, the planar housing surface, which is denoted by 21. In addition, in this illustration the dovetail configuration for the connection between the slide elements 8', 8", 8'" and the support element 7 can be readily seen. The support element 7 has, as evident, three recesses which extend in the longitudinal direction z and into which the slide elements are respectively insertable. Recesses in the form of three fastening grooves 32, 33 each for mechanically positive reception of a respective slide element are provided in the support element 7. The slide elements 8', 8", 8'" are formed as plate-shaped bodies. The fastening grooves have undercuts extending in the longitudinal direction z; the slide elements have wedge-shaped edge sections complementary to the undercuts. In FIG. 9 the undercuts of the fastening groove 32 are denoted by 34 and the edge sections of the corresponding slide element by 35. The present multi-part arrangement and the dovetail configuration differ from the unitary forms of embodiment additionally by smaller contact areas (or slide areas) relative to or with respect to the guide rail.

Figure 10:
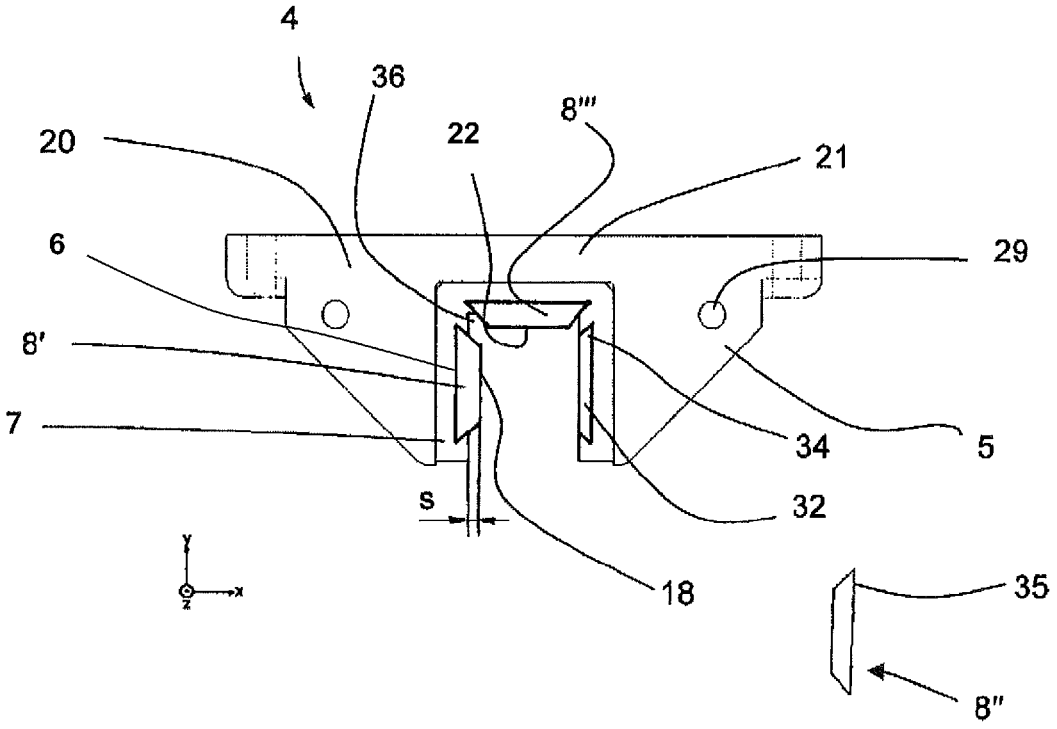
FIG. 10 shows a plan view of the sliding guide shoe.

As apparent from, primarily, the plan view according to FIG. 10 the slide elements 8', 8", 8'" of the insert 6 are respectively received in specific mode and manner mechanically positively in the fastening grooves 32, 33 of the support element 7. For clarification of the form of connection the slide element denoted by 8" on the righthand side was, in the illustration according to FIG. 10, removed from the fastening groove, here similarly denoted by 32. The fastening groove 32 has an undercut 34 extending in the longitudinal direction; the slide element 8" has corresponding wedge-shaped edge sections 35. By this dovetail connection the slide elements are retained in simple mode and manner in the support element captivelyc towards the inside. It is further apparent from FIG. 10 that the slide elements 18, 22 protrude relative to the respective, inwardly facing surfaces of the support element 7 by a spacing s which can be approximately 2 millimeters. In addition, open intermediate spaces can be formed in the edge region between the individual slide elements 8', 8", 8'". Tests have shown that unexpectedly a further improved slide property of the guide shoe during car travel results.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A sliding guide shoe for an elevator for conveying persons or goods, comprising:

a guide shoe housing; and an insert inserted into the guide shoe housing for guiding an elevator car along a guide rail extending in a longitudinal direction, wherein the insert is formed of at least two parts including at least one slide element and a support element, wherein the support element when inserted in the guide shoe housing is formed as profile member which is U-shaped in cross-section, wherein the at least one slide element is detachably connected with the support element and is removable from and insertable into the sliding guide shoe in the longitudinal direction only laterally from a single longitudinal side of the guide shoe housing, wherein the support element has at least one recess formed therein extending in the longitudinal direction up to a shoulder of the support element, the shoulder and the support element formed as a one-piece unitary structure, wherein the at least one recess forms a receptacle for the at least one slide element, and the shoulder forms an abutment for the at least one slide element, up to which the at least one slide element can be pushed into the support element from the longitudinal side of the guide shoe housing, and wherein the at least one slide element is supported on the shoulder of the support element.

2. The sliding guide shoe according to claim 1 wherein the support element has a recess which extends up to the shoulder and forms a receiving section for reception of the slide element.

3. The sliding guide shoe according to claim 2 wherein the sliding guide shoe has mutually opposite slide surfaces and a slide surface extending transversely thereto, wherein the at least one slide element is formed as an integral component having the mutually opposite and transverse slide surfaces thereon.

4. The sliding guide shoe according to claim 1 wherein the sliding guide shoe has mutually opposite slide surfaces and a slide surface extending transversely thereto and is formed from three slide elements each having one of the mutually opposite slide surfaces and the transverse slide surface thereon.

5. The sliding guide shoe according to claim 4 wherein the three slide elements are formed as plate-shaped bodies.

6. The sliding guide shoe according to claim 4 wherein the support element has three fastening grooves formed therein as recesses each for a mechanically positive reception of a respective one of the slide elements.

7. The sliding guide shoe according to claim 4 including a dovetail connection between the slide elements and the support element wherein the fastening grooves have undercuts and the slide elements have wedge-shaped edge sections complementary with the undercuts.

8. The sliding guide shoe according to claim 1 including a holding element fastened to the guide shoe housing at the longitudinal side for securing the at least one slide element in the guide shoe housing.

9. The sliding guide shoe according to claim 8 including a protective element for protecting the slide surfaces from contaminations, the protective element being mounted at the holding element on an inner side of the holding element facing the at least one slide element.

10. The sliding guide shoe according to claim 9 wherein the protective element is formed of a non-metallic material.

11. The sliding guide shoe according to claim 9 wherein the protective element is formed of a plastics material.

12. The sliding guide shoe according to claim 1 wherein the at least one slide element projects beyond at least one of the support element and the guide shoe housing.

13. The sliding guide shoe according to claim 1, wherein a portion of the at least one slide element projects beyond the guide shoe housing when the at least one slide element is inserted into the guide shoe housing.

14. A sliding guide shoe for an elevator for conveying persons or goods, comprising:

a guide shoe housing; and an insert inserted into the guide shoe housing for guiding an elevator car along a guide rail extending in a longitudinal direction, wherein the sliding guide shoe has mutually opposite slide surfaces and a slide surface extending transversely thereto, wherein the insert is of multi-part construction and includes three slide elements and a support element, wherein each of the slide elements forms a respective one of the slide surfaces, wherein three fastening grooves are formed in the support element as recesses receiving a respective one of the slide elements, and wherein the slide elements are connected with the support element to permit lateral removal from the sliding guide shoe in the longitudinal direction out of the fastening grooves and insertion into the fastening grooves, wherein the slide elements can be pushed into or pulled out of the support element only from a single longitudinal side of the guide shoe housing, wherein at least one of the slide elements is supported on one side by a shoulder formed on the support element, the shoulder and the support element formed as a one-piece unitary structure, and wherein the shoulder forms an abutment for the at least one of the slide elements, up to which the at least one of the slide elements can be pushed into the support element from the longitudinal side of the guide shoe housing.

15. The sliding guide shoe according to claim 14 wherein the slide elements are formed as plate-shaped bodies.

16. The sliding guide shoe according to claim 14 including a dovetail connection between the slide elements and the support element formed by undercuts in each of the fastening grooves and complementary wedge-shaped edge sections on each of the slide elements.

17. A method of updating an elevator installation comprising the steps of:

a. stopping an elevator car guided by at least one sliding guide shoe along a guide rail in a longitudinal direction, the at least one sliding guide shoe having a guide shoe housing and an insert inserted into the guide shoe housing, the insert including at least one slide element retained in at least one recess of a support element, the support element having a shoulder, the shoulder and the support element formed as a one-piece unitary structure, wherein the at least one slide element is detachably connected with the support element and is removable from and insertable into the sliding guide shoe in the longitudinal direction only laterally from a single longitudinal side of the guide shoe housing; and b. updating the at least one sliding guide shoe by exchanging the at least one slide element for a new slide element, performing the exchange by removing the at least one slide element from the support element by lateral withdrawal in the longitudinal direction from the at least one sliding guide shoe and inserting the new slide element into the support element of the at least one sliding guide shoe in the longitudinal direction, wherein the shoulder foul's an abutment for the new slide element, up to which the new slide element can be pushed into the support element from the longitudinal side of the guide shoe housing.

18. A sliding guide shoe for an elevator for conveying persons or goods, comprising:

a guide shoe housing; and an insert inserted into the guide shoe housing for guiding an elevator car along a guide rail extending in a longitudinal direction, wherein the insert is formed of at least two parts including at least one slide element and a support element, wherein the support element when inserted in the guide shoe housing is formed as profile member which is U-shaped in cross-section, wherein the at least one slide element is detachably connected with the support element and is removable from and insertable into the sliding guide shoe in the longitudinal direction only laterally from a longitudinal side of the guide shoe housing, wherein the support element has at least one recess formed therein extending in the longitudinal direction up to a shoulder of the support element, wherein the at least one recess forms a receptacle for the at least one slide element, and wherein the at least one slide element is supported on the shoulder of the support element, wherein a portion of the at least one slide element projects beyond the guide shoe housing when the at least one slide element is inserted into the guide shoe housing, and wherein the support element is substantially flush with the guide shoe housing when the support element is inserted into the guide shoe housing.

* * * * *